United States Patent [19]

Fleischer et al.

[11] Patent Number: 4,704,971

[45] Date of Patent: Nov. 10, 1987

[54] PULVERIZED-COAL BURNER

[75] Inventors: Klaus Fleischer; Peter Göhler; Rolf Mangler; Christian Reuther; Manfred Schingnitz, all of Freiberg; Friedrich Berger, Brand-Erbisdorf, all of German Democratic Rep.; Ernest Gudymov, Moskau, U.S.S.R.; Vladimir Semenov, Moskau, U.S.S.R.; Vasilij Fedotov, Moskau, U.S.S.R.; Boris Rodionov, Moskau, U.S.S.R.

[73] Assignee: Brennstoffinstitut Freiberg, Freiberg, German Democratic Rep.

[21] Appl. No.: 938,727

[22] Filed: Dec. 5, 1986

Related U.S. Application Data

[63] Continuation of Ser. No. 875,319, Jun. 16, 1986, abandoned.

[30] Foreign Application Priority Data

Nov. 12, 1985 [DD] German Democratic Rep. ..... 2827484

[51] Int. Cl.[4] ..... F23D 1/02

[52] U.S. Cl. ..... 110/264; 110/261; 110/347; 431/284

[58] Field of Search ..... 110/260, 261, 262, 264, 110/347; 431/284, 285

[56] References Cited

U.S. PATENT DOCUMENTS

| | | | |
|---|---|---|---|
| 4,422,389 | 12/1983 | Schroder | 110/264 |
| 4,466,363 | 8/1984 | Leikert et al. | 110/347 |
| 4,555,994 | 12/1985 | Voigt et al. | 110/261 |
| 4,597,342 | 7/1986 | Green et al. | 110/264 X |

FOREIGN PATENT DOCUMENTS

| | | |
|---|---|---|
| 276285 | 1/1982 | German Democratic Rep. . |
| 228338 | 9/1984 | German Democratic Rep. . |

*Primary Examiner*—Edward G. Favors

*Attorney, Agent, or Firm*—Michael J. Striker

[57] ABSTRACT

The invention relates to burners for the gasification of pulverized coal—injected in a dense phase—with steam and oxygen, and it can be employed for coal gasification in the chemical industry. Objects of the present invention are to increase the reliability in operation of the burner and to improve the quality of the gas obtained from the gasification process. The burner should be designed in such a way that a reliable operation is attained under the conditions of the gasification process (e. g. high pressures and temperatures within the gasifier). The design of the pulverized-coal feeding device, the water-cooled jacket and the swirl chamber according to the invention are described in detail.

7 Claims, 3 Drawing Figures

PULVERIZED-COAL BURNER

Figure 1:
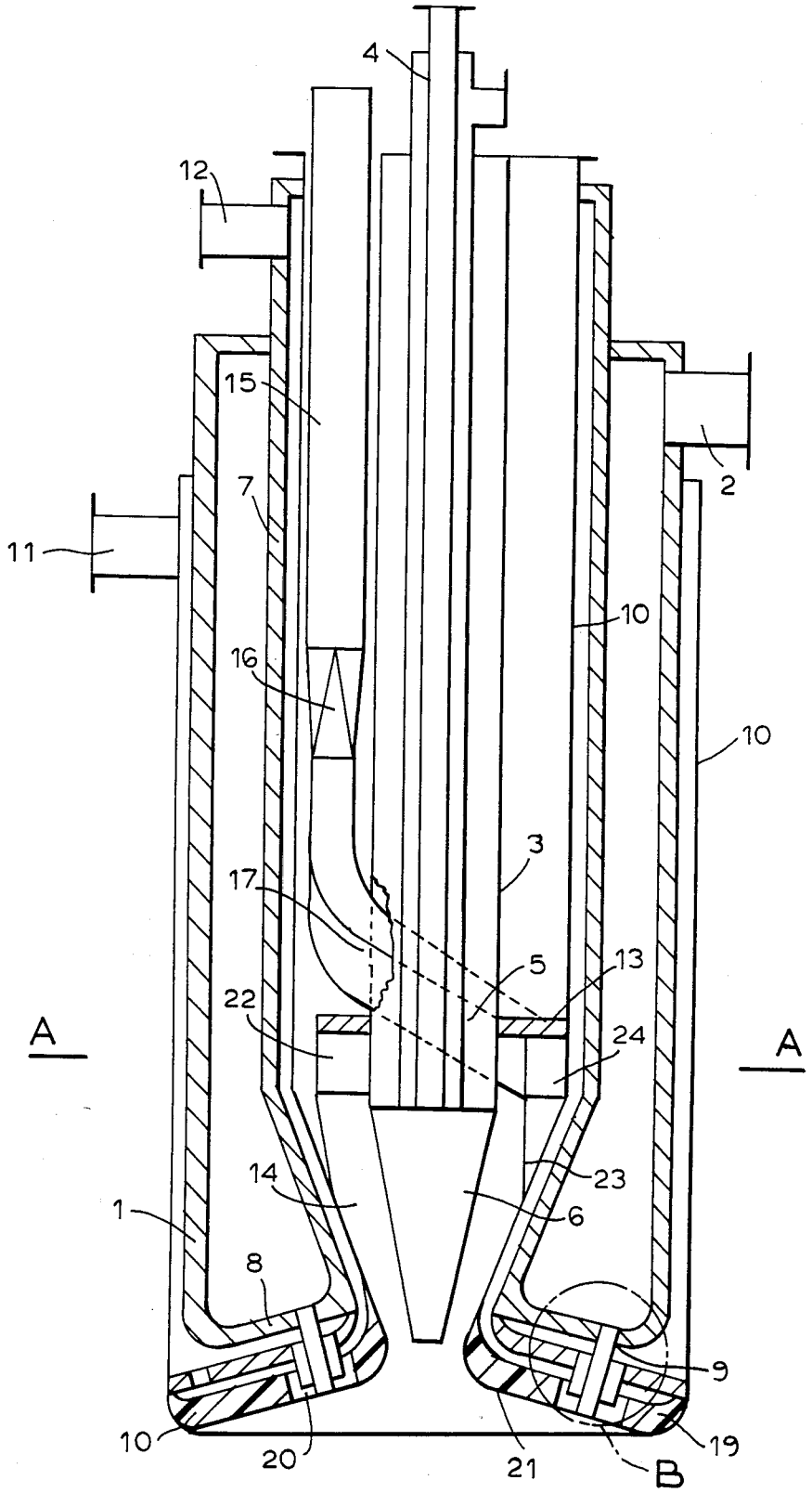

This is a continuation of application Ser. No. 875,319, filed June 16, 1986, now abandoned.

FIELD OF THE INVENTION

The invention relates to burners for the gasification of pulverized coal—injected in a dense phase—with steam and oxygen, and it can be employed for coal gasification in the chemical industry.

BACKGROUND OF THE INVENTION

A conventional pulverized-coal burner comprises a housing provided with an inlet pipe connection for steam supply; a central tube with ducts for supplying a fuel gas and an oxygen-containing gas, and with a combustion chamber provided at the end of said central tube; a pipe section arranged between the housing and the central tube; coiled tubular elements for supplying pulverized coal which are arranged helically around the central tube; and ducts for supplying an oxidizing agent which are connected to an inlet manifold and to an outlet manifold, the latter being provided with a number of discharge nozzles (Application DD, No. F 23 D/266 958).

However, the burner described above has the following disadvantages: a low reliability in operation and a poor quality of the gas produced. The low reliability of this conventional pulverized-coal burner is due to the following: the discharge nozzles for the supply of the oxidizing agent are provided on the outlet manifold and are arranged between the housing and the jacket section, whereas the openings of the discharge nozzles are on a level with the discharge area of the housing. Since there is a continuous circulation of steam in the space between the housing and the jacket section, and since the ducts for the supply of the oxidizing agent are purged with steam prior to start-up, the discharge nozzles have a high temperature prior to the oxygen supply (normally 300° to 400° C.) which is due to the high temperature of the steam. During oxygen supply and the ignition of the pulverized coal the discharge nozzles are subjected to a further heating due to the radiation of the flame. The metal of the discharge nozzles is oxidized by the jet of oxidizing agent and even ignites if technical oxygen is used as an oxidizing agent.

The poor quality of the gas obtained from the gasification process is due to the fact that the flow of pulverized coal from the swirl chamber into the reaction chamber is nonuniform. The pulverized coal is supplied in a dense phase from a feed bin via several ducts to the pulverized-coal burner. In the swirl chamber the weak pulsations of the pulverized-coal streams from the individual ducts superimpose each other and are intensified, thus creating a strongly pulsating pulverized-coal flow at the burner port. Consequently, within a specified period of time a constant flow of oxidizing agent mixes with varying amounts of pulverized coal. This has an adverse effect on the quality of the gas produced. With a reduction of the throughput of pulverized coal the percentages of carbon monoxide and hydrogen in the producer gas decrease, and an increase of the pulverized-coal throughput hampers the gasification process: the amounts of carbon monoxide and hydrogen produced are too small, and the gas contains substantial quantities of unreacted carbon.

With respect to design and effects to be attained a pulverized-coal burner characterized by the features summarized below is quite similar to the proposed invention. A housing provided with an inlet pipe connection for the supply of a mixture of steam and an oxidizing agent comprises a pipe section and a central tube which are arranged coaxially to form annular spaces. The central tube is provided with ducts for supplying a fuel gas and an oxygen-containing gas, with the outlets of these ducts opening into a combustion chamber to produce a pilot flame. Coiled tubular elements for supplying pulverized coal are arranged helically around the central tube and open into a swirl chamber which is bounded by a transverse partition between the central tube and the pipe section and by the lower parts of the pipe section and the central tube. The space between the housing and the pipe section is closed by a bottom plate which is provided with a water-cooled jacket as are the housing and the pipe section. This bottom plate is provided with discharge nozzles for the supply of a mixture of steam and an oxidizing agent which pass through the water-cooled jacket and open to the outside (Application DD, No. F 23 D/276 285).

This burner has disadvantages as well, i.e. a low reliability in operation and a poor quality of the gas produced. The low reliability of this type of pulverized-coal burner is due to the fact that the discharge nozzles for oxidizing agent supply which are provided in the bottom plate and pass through the water-cooled jacket are cooled insufficiently. The cooling water flows laterally around the nozzles thereby forming a stagnation zone on their opposite side, and cooling effects are considerably reduced in this area; the coolant may even boil in some places and the water-cooled jacket may burn through around the nozzles. Another reason for the low reliability of the conventional pulverized-coal burner is that the cooling jacket is in no way protected against flame action and that the metal is exposed to the detrimental effects of large heat flows ($300–800 \cdot 10^3$ $kcal/m^2 \cdot h$).

The poor quality of the gas produced is due to the fact that the flow of pulverized coal into the reaction chamber is non-uniform. If a single stream of pulverized coal is supplied to the swirl chamber in a dense phase, it is not possible to attain a uniform distribution of the pulverized coal in the outlet area of the chamber since the flow does not fully rotate in the chamber. Thus, an area of an increased concentration of pulverized coal and an area of a reduced concentration of pulverized coal are formed in the reaction chamber, and more particularly close to the burner port. Since the oxidizing agent is supplied to the reaction chamber in a uniform flow, such an unfavorable distribution of the pulverized coal considerably impairs the quality of the gas obtained.

In the process of dense-phase conveying and feeding of the pulverized coal into the swirl chamber via several ducts the following phenomenon is observed: in the chamber the weak pulsations of the pulverized-coal streams from the individual ducts superimpose each other. Consequently, the entire stream of pulverized coal begins to pulsate strongly, the flow into the reaction chamber is nonuniform and this, in turn, has an adverse effect on the quality of the gas obtained form the gasification process.

OBJECT OF THE INVENTION

It is the object of the present invention to increase the reliability in operation of the burner and to improve the quality of the gas obtained from the gasification process.

SUMMARY OF THE INVENTION

The invention is based on the task to provide a burner designed in such a way that a high reliability in operation is attained and that the requirements of the gasification process (e.g. high pressures and temperatures within the gasifier) are met. A pulverized-coal burner according to the invention comprises a housing with an inlet pipe connection for the supply of a mixture of steam and an oxidizing agent; a central tube provided with ducts for supplying a fuel gas and an oxidizing agent, and with a combustion chamber at the end thereof into which said ducts open; a pipe section arranged between the housing and the central tube thereby forming annular chambers; a device for the supply of pulverized coal provided in the annular chamber between the central tube and said pipe section; a transverse partition provided between the central tube and the pipe section which forms a swirl chamber opening at the bottom, into which the device for the supply of pulverized coal extends; a bottom plate closing the annular chamber between the pipe section and the housing; a water-cooled jacket enclosing the housing, the bottom plate and the pipe section; and a great number of discharge nozzles for the supply of a mixture of steam and an oxidizing agent, these nozzles being provided in said bottom plate, passing through the water-cooled jacket and opening to the outside. This burner is provided with an annular plate between the bottom plate and the water-cooled jacket, this plate having openings corresponding to the discharge nozzles, one edge of this plate being fixed to the bottom plate and the other edge, to the water-cooled jacket; the openings in the annular plate are provided with sleeves arranged coaxially with the corresponding discharge nozzles in such a way that annular clearances are formed between said nozzles and said sleeves; said sleeves extend into cup-shaped recesses provided coaxially in the surface of the water-cooled jacket thereby forming annular clearances as well; the external surface of the water-cooled jacket is provided with a refractory layer at least in the bottom area. Additionally, according to the invention, the swirl chamber is provided with a helical swirling device whose inlet is connected to the pulverized-coal feeding device which has the form of a tube arranged helically around the central tube and which changes into a duct having a rectangular cross section and opening into the swirl chamber. The helical swirling device consists of a cylindrical part and an adjacent conical part, with an Archimedean spiral serving as a guide. The thickness of the refractory layer on the outside of the water-cooled jacket corresponds to the weight of the cup-shaped recesses.

Figure 2:
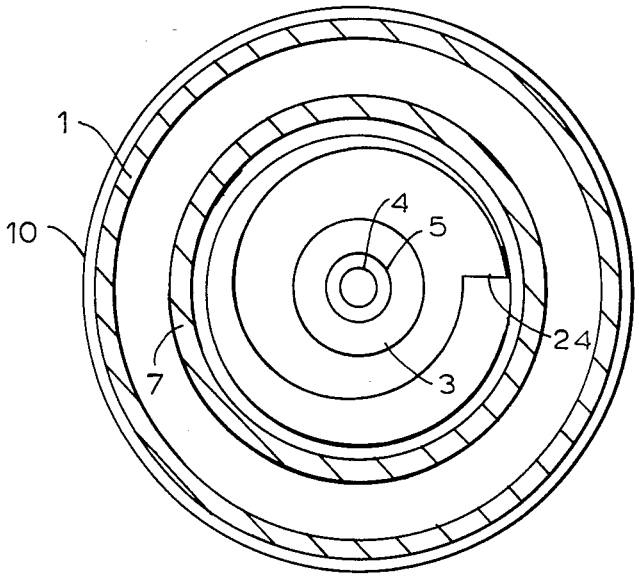

FIG. 1 of the accompanying drawings is a longitudinal section of the proposed burner;

FIG. 2 shows the cross-sectional area A—A of FIG. 1, and

Figure 3:
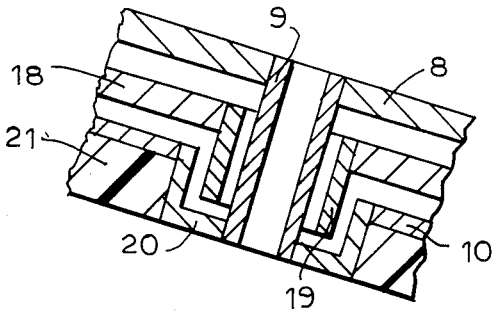

FIG. 3, the sectional view marked B in FIG. 1.

The burner comprises a housing 1 with an inlet pipe connection 2 for the supply of a mixture of steam and an oxidizing agent; central tube 3 with ducts 4 and 5 for supplying a fuel gas and an oxidizing agent, these ducts opening into a combustion chamber 6; a pipe section 7 arranged between the housing 1 and the central tube 3; a bottom plate 8 provided in the burner port area in the space between the housing 1 and the pipe section 7, with discharge nozzles 9 for the supply of a mixture of steam and an oxidizing agent arranged in said bottom plate 8. The discharge nozzles 9 open to the outside and are passed through the water-cooled jacket 10 which is provided with an inlet pipe connection 11 for water supply and an outlet pipe connection 12 for water discharge. The water-cooled jacket 10 encloses the housing 1, the pipe section 7 and the bottom plate 8. In the lower part of the housing 1 a transverse partition 13 is installed between the central tube 3 and the pipe section 7 so as to form a swirl chamber 14. The pulverized-coal feeding device is shaped like a tube 15 which is connected, by means of a transition element 16, to a duct 17 having a rectangular cross section and being arranged helically around the central tube 3. A partition-type annular plate 18 with openings is fitted with its edges to the bottom plate 8 and the water-cooled jacket 10. The openings in the annular plate 13—each surrounding a discharge nozzle 9—are provided with sleeves 19 arranged coaxially with said nozzles and extending into cup-shaped recesses 20 thereby leaving clearances at their ends. These cup-shaped recesses 20 are provided in a refractory layer 21 lining the bottom of the water-cooled jacket 10. The thickness of the refractory layer 21 corresponds to the height of the cup-shaped recesses 20. Additionally, the swirl chamber 14 is provided with a helical swirling device comprising a cylindrical upper part 22 and a conical lower part 23. An Archimedean spiral serves as a guiding device for the surfaces of the cylindrical and conical parts. The helical swirling device has a rectangular inlet 24 connected with the duct 17 of the pulverized-coal feeding device having a rectangular cross section as well.

The burner is operated as follows: Cooling water is supplied via the inlet pipe connection 11 and flows around the housing 1 by circulating in the space between the housing 1 and the jacket 10. The cooling water supplied is divided into two streams upstream of the annular plate 18. One stream flows through the openings and down to the bottom of the jacket 10. The second stream of cooling water passes the annular clearances between the discharge nozzles 9 and the sleeves 19, impinges against the cup-shaped recesses 20, thereby ensuring a high heat transfer coefficient, flows through the annular clearances between the cup-shaped recesses 20 and the sleeves 19 and then into the space between the annular plate 18 and the bottom of the jacket 10; there the two streams of cooling water combine. The entire stream of cooling water enters the space between the pipe section 7 and the jacket 10 and is discharged through the outlet pipe connection 12. Fuel gas is supplied through the duct 4, and an oxidizing agent, through the duct 5; these two media are burnt in the combustion chamber 6. The hot combustion products are passed from the combustion chamber 6 into the reaction chamber of the gas producer. Steam is supplied through the inlet pipe connection 2, and then the pulverized coal is fed in a dense phase, passing the tube 15, a transition element 16 for changeover from a circular to a rectangular cross section, and the duct 17 having a rectangular cross section. The pulverized coal then passes the transverse partition 13 and enters inlet 24 of the helical swirling device which helps to attain a uniform distribution of the coal stream at the outlet of the swirl chamber 14. The uniform stream of pulverized coal is passed into the reaction chamber of the gas producer. The mixture of steam and an oxidizing agent is supplied via the inlet pipe connection 2. This mixture passes the discharge nozzles 9 at a high rate, thereby entraining, and mixing with, the pulverized coal and mixing also with the hot combustion products from the combustion chamber 6. In this process the pulverized coal is ignited and burnt in the presence of an oxidizing agent and steam.

The proposed burner has the following advantages: An annular plate with openings is installed between the bottom plate and the water-cooled jacket, and these openings surrounding the discharge nozzles are provided with sleeve whose lower ends extend into cup-shaped recesses thereby leaving clearances. By such a design a uniform cooling of the discharge nozzles is attained, any local boiling of the cooling water is prevented and thus a high reliability in operation of the burner is achieved. Since the bottom of the jacket is provided with a refractory layer whose thickness corresponds to the height of the cup-shaped recesses, the flow of heat in the bottom of the water-cooled jacket is substantially reduced, and this contributes to an increase of the reliability of the burner. The swirl chamber is provided with a helical swirling device comprising a rectangular inlet, a cylindrical upper part and a conical lower part; and the pulverized-coal feeding device is shaped like a tube which is connected, by means of a transition element, to a duct having a rectangular cross section and being arranged helically around the central tube; by such a design a uniform distribution of the stream of pulverized coal, without any pulsations, is achieved at the burner port. As a result, the quality of the gas obtained from the gasification process is considerably improved.

The following table summarizes the operating results obtained with burners manufactured according to the prototype burner and according to the pulverized-coal burner of the present invention.

The two burners were operated as follows: Pulverized coal consumption—22,500 kg/h; consumption of technical oxygen—8,300 $m^3(n)/h$; steam consumption—550 $m^3(n)/h$. A feed coal having the following composition was used for burner testing: C—51.0%; H—4.0%; O—24.0%; N—0.4%; moisture—10.0%; ash—10%; sulphur—0.6%.

TABLE

| Description | Composition of Gas from Gasification | | | | | | | Unburnt Carbon |
|---|---|---|---|---|---|---|---|---|
| | $H_2O$ % | $N_2$ % | $H_2$ % | CO % | $CO_2$ % | $CH_4$ % | $H_2S$ % | g/m³ (n) |
| Burner according to prototype | 21.1 | 4.4 | 22.9 | 40.6 | 10.3 | 0.4 | 0.2 | 57 |
| Burner according to present invention | 18.5 | 4.3 | 25.5 | 42.6 | 8.5 | 0.4 | 0.2 | 7 |

The above table shows that the quality of the gas obtained by means of the burner according to the present invention is much higher than that of the gas produced by means of the conventional burner. For the burner according to the invention the total output of carbon monoxide and hydrogen is 68.1 vol. % and the residual carbon concentration is 7 $g/m^3(n)$, whereas for the conventional burner the total output of carbon monoxide and hydrogen is 63.5 vol. % and the residual carbon concentration is 57 $g/m^3(n)$.

We claim:

1. A pulverized-coal burner comprising a housing (1) with an inlet pipe connection (2) for the supply of a mixture of steam and an oxidizing agent;

a central tube (3) with a duct (4) for supplying a fuel gas, a duct (5) for supplying an oxidizing agent, and a combustion chamber (6) arranged at the lower end of said central tube with said duct opening into said combustion chamber;

a pipe section (7) arranged between the housing (1) and the central tube (3) thereby forming annular chambers;

a pulverized-coal feeding device provided in the annular chamber between the central tube (3) and said pipe section (7);

a transverse partition provided between the central tube (3) and the pipe section (7) which forms a swirl chamber (14) opening at the bottom, into which the pulverized-coal feeding device extends;

a bottom plate (8) closing the annular chamber between the pipe section (7) and the housing (1);

a water-cooled jacket (10) enclosing the housing (1), the bottom plate (8) and the pipe section (7); and a great number of discharge nozzles (9) for the supply of a mixture of steam and an oxidizing agent, these nozzles being provided in said bottom plate (8), passing through the water-cooled jacket (10) and opening to the outside;

and characterized in that an annular plate (18) is provided between the plate (8) and the water-cooled jacket (10), this plate having openings corresponding to the discharge nozzles (9), one edge of this annular plate (18) being fixed to the bottom plate (8) and the other edge, to the jacket (10); that the openings in said plate (18) are provided with sleeves (19) arranged coaxially with the corresponding discharge nozzles (9) in such a way that annular clearances are formed between said discharge nozzles (9) and said sleeves (19), said sleeves (19) extending into cup-shaped recesses (20) provided coaxially in the surface of the water-cooled jacket (10) thereby forming clearances as well.

2. A pulverized-coal burner according to claim 1, characterized in that the water-cooled jacket (10) has an external surface which is provided with a refractory layer at least in the bottom area (21).

3. A pulverized-coal burner according to claim 1, characterized in that the swirl chamber (14) is provided with a helical swirling device whose inlet (24) is connected to the pulverized-coal feeding device which is shaped like a tube (15) arranged helically around the central tube (3) and which changes into a duct having a rectangular cross section (17) and opening into the swirl chamber (14).

4. A pulverized-coal burner as defined in claim 3, characterized in that the helical swirling device consists of a cylindrical part (22) and an adjacent conical part (23), with an Archimedean spiral serving as a guide.

5. A pulverized-coal burner according to claim 2, characterized in that the thickness of the refractory layer (21) corresponds to the height of the cup-shaped recesses (20) in the water-cooled jacket (10).

6. A pulverized-coal burner comprising a housing (1) with an inlet pipe connection (2) for the supply of a mixture of steam and an oxidizing agent;

a central tube (3) with a duct (4) for supplying a fuel gas, a duct (5) for supplying an oxidizing agent, and a combustion chamber 6 arranged at the lower end of said central tube with said duct opening into said combustion chamber;

a pipe section (7) arranged between the housing (1) and the central tube (3) thereby forming annular chambers;

a pulverized-coal feeding device provided in the annular chamber between the central tube 3 and said pipe section (7);

a transverse partition provided between the central tube (3) and the pipe section (7) which forms a swirl chamber (14) opening at the bottom, into which the pulverized-coal feeding device extends;

a bottom plate (8) closing the annular chamber between the pipe section (7) and the housing (1);

a water-cooled jacket (10) enclosing the housing (1), the bottom plate (8) and the pipe section (7); and a great number of discharge nozzles (9) for the supply of a mixture of steam and an oxidizing agent, these nozzles being provided in said bottom plate (8), passing through the water-cooled jacket (10) and opening to the outside;

and characterized in that the swirl chamber (14) is provided with a helical swirling device whose inlet (24) is connected with the pulverized-coal feeding device which is shaped like a tube (15) arranged helically around the central tube (3) and which changes into a duct having a rectangular cross section (17) and opening into the swirl chamber (14).

7. A pulverized-coal burner according to claim 6, characterized in that the helical swirling device consists of a cylindrical part (22) and an adjacent conical part (23), with an Archimedean spiral serving as a guide.

* * * * *